US006722936B2

(12) United States Patent
Hammel

(10) Patent No.: US 6,722,936 B2
(45) Date of Patent: Apr. 20, 2004

(54) METHOD FOR PRODUCING A FIELD EMISSION DISPLAY

(75) Inventor: Ernst Hammel, Vienna (AT)

(73) Assignee: Electrovac, Fabrikation elektrotechnischer Spezialartikel Gesellschaft m.b.H., Klosterneuburg (AT)

( * ) Notice: Subject to any disclaimer, the term of this patent is extended or adjusted under 35 U.S.C. 154(b) by 0 days.

(21) Appl. No.: 10/120,592

(22) Filed: Apr. 11, 2002

(65) Prior Publication Data

US 2002/0119724 A1 Aug. 29, 2002

Related U.S. Application Data

(63) Continuation of application No. PCT/AT00/00249, filed on Sep. 20, 2000.

(30) Foreign Application Priority Data

Oct. 15, 1999 (AT) ..... 1744/99

(51) Int. Cl.[7] ..... H01J 9/24; H01J 9/26; H01J 9/04

(52) U.S. Cl. ..... 445/24; 445/25; 445/50; 445/51

(58) Field of Search ..... 445/24, 25, 49–51; 427/77, 78, 226, 122, 249.1, 903

(56) References Cited

U.S. PATENT DOCUMENTS

| | | | | | |
|---|---|---|---|---|---|
| 5,505,647 | A | * | 4/1996 | Sato et al. | 445/25 |
| 5,723,367 | A | * | 3/1998 | Wada et al. | 438/660 |
| 5,944,573 | A | | 8/1999 | Mearini et al. | |
| 5,997,378 | A | | 12/1999 | Dynka et al. | |
| 6,129,602 | A | * | 10/2000 | Yamanobe | 445/24 |
| 6,213,834 | B1 | * | 4/2001 | Ohnishi et al. | 445/6 |
| 6,232,706 | B1 | * | 5/2001 | Dai et al. | 313/309 |
| 6,236,159 | B1 | * | 5/2001 | Inoue et al. | 313/582 |
| 6,416,374 | B1 | * | 7/2002 | Mitome et al. | 445/6 |
| 6,440,763 | B1 | * | 8/2002 | Hsu | 438/20 |
| 6,514,113 | B1 | * | 2/2003 | Lee et al. | 445/50 |
| 6,630,772 | B1 | * | 10/2003 | Bower et al. | 313/311 |
| 2002/0009944 | A1 | * | 1/2002 | Ouchi | 445/24 |

FOREIGN PATENT DOCUMENTS

| | | |
|---|---|---|
| EP | 0 777 253 A | 6/1997 |
| EP | 0 800 198 A | 10/1997 |
| FR | 2 705 163 A | 11/1994 |
| JP | 09330654 A | 12/1997 |

OTHER PUBLICATIONS

Production of carbon nanotubes, C. Journet, P. Bernier, Applied Physics A Materials Science & Prosessing, Feb. 25, 1998.

Unraveling Nanotubes: Field Emission from an Atomic Wire, A.G. Rinzier, J.H. Hafner et al., Science vol. 269, Sep. 15, 1995.

A Carbon Nanotube Field–Emission Electron Source, Walt A. de Heer, A. Chatelain, D. Ugarte, Science vol. 270, Nov. 17, 1995.

Field Emission form single–wall Carbon Nanotube Films, Jean–Marc Bonard, Jean–Paul Salvetat et al., American Institute of Physics, vol. 73, No. 7., Aug. 17, 1998.

* cited by examiner

*Primary Examiner*—Kenneth J. Ramsey
*Assistant Examiner*—German Colón
(74) *Attorney, Agent, or Firm*—Henry M. Feiereisen

(57) ABSTRACT

The invention relates to a method for producing a field emission display (FED) that includes a first substrate with electrodes of an anode structure and a luminescent material that at least partly covers these electrodes. The electrodes of a cathode structure are affixed on a second substrate and include field emitters. The anode structure and the cathode structure are aligned with one another and interconnected in spaced-apart disposition in a gas-tight manner along their lateral edges, except for a gas inlet opening and a gas outlet opening. The field emitters are deposited by heating only the electrodes of the cathode structure while flowing a carrier gas through the gas inlet opening and the gas outlet opening.

6 Claims, 1 Drawing Sheet

METHOD FOR PRODUCING A FIELD EMISSION DISPLAY

CROSS-REFERENCES TO RELATED APPLICATIONS

This application is a continuation of prior filed copending PCT International application No. PCT/AT00/00249, filed Sep. 20, 2000.

This application claims the priority of Austrian Patent Application, Serial No. A 1744/99, filed Oct. 15, 1999, pursuant to 35 U.S.C. 119(a)–(d), the subject matter of which is incorporated herein by reference.

BACKGROUND OF THE INVENTION

The present invention relates to a method for producing a field emission display (FED), and more particularly to a method for forming field emitters by depositing a field emitter material from a carrier gas in a space formed between an anode structure and a cathode structure.

A flat display screen is an electronic display composed of a large area filled with individual pixels. These pixels can be arranged side-by-side in the form of a two-dimensional matrix, such as a checkerboard pattern. Various types of flat panel displays, such as electroluminescence, AC-plasma, DC-plasma and field emission display screens, can be produced by several processes known in the art.

The present invention relates in particular to field emission display screens, which have a cathode and an anode structure arranged with a relatively small spacing therebetween. Electrons are emitted from the cathode by applying an electric field between the cathode and anode and propelled towards the anode. To facilitate electron emission, the electrodes of the cathode structures are covered at least in part with a field emitter made of a material with advantageous field emission properties.

The anode structure is transparent and coated with a luminescent material, such as a phosphor, which lights up at those locations that are struck by the emitted electrons.

Conventional field emission display screens are presently produced by manufacturing complete anode and cathode structures on flat substrates, including the electrodes, as well as the layer of luminescent material applied to the anode structure and the field emitters applied to the cathode structure. The anode and cathode structure are subsequently placed against each other and sealingly connected with one another along their lateral edges in a gas-tight manner, optionally by interposing a spacer and/or a grid electrode. In a last step, the space between the cathode and anode structure is evacuated so that the electrodes can travel essentially unimpededly from the cathode to the anode.

The cathode structure, and more particularly the surface of the field emitters provided on the cathode structure, has to be kept in a clean environment, i.e., kept free of dust particles, between the time of manufacture and the time when the cathode structure is attached to the anode structure. Dust particles that settle on a field emitter surface, can prevent electrons emitted from the cathode in the region of these particles from reaching the anode, causing the display to malfunction in that region. If dust particles residing on the surface of the field emitters are not detected in due time and removed before the anode and cathode structures are assembled, then the FED will exhibit defects and become unusable and may have to be scrapped. The manufacture of FED with a high yield therefore tends to require clean rooms, which increases the complexity and cost of their manufacture.

European Pat. No. EP 0 800 198 A discloses a method for producing a field emission display with a base plate and a cover plate, a phosphor layer and a substrate with an electrode structure. According to the disclosed method, a carbon-containing field emitting layer is deposited on the substrate from a carbon-containing gas, such as acetylene, in the space between the base plate and the cover plate of the display.

In a first activation step, the electrode structure is formed on the substrate, while the carbon-containing film is formed in a second activation step. Any residual organic materials in the display are removed in a stabilization step. In a final finishing step, additional organic material is introduced in the interior space of the display to slow degradation of the field-emitting carbon-containing layer during the operating life of the display. By introducing organic materials, the atoms that are removed from the field-emitting layer during activation of individual pixels are replaced by the carbon atoms in the vacuum. This essentially represents an equilibrium process, with the average absorption time of the organic materials advantageously in the range of the activation frequency of the display, which for typical computer displays is approximately 60 Hz.

It would therefore be desirable and advantageous to provide a less complex process for producing field emission display screens which can be manufactured in an environment that does not require stringent clean room conditions.

SUMMARY OF THE INVENTION

According to one aspect of the invention, the electrodes of the anode structure are disposed on a first substrate and the electrodes of the cathode structure are disposed on a second substrate. The luminescent layer formed of the luminescent material is then deposited over the electrodes of the anode structure, whereafter the cathode structure and the anode structure with the luminescent layer are joined while facing each another so as to form a gas-tight seal along their lateral edges, except for a gas inlet port and a gas outlet port. After the cathode and anode structure are sealingly connected with one another in a gas-tight manner, a carrier gas is introduced through the gas inlet port between the cathode and the anode structure to deposit the field emitters on the electrodes of the cathode structure.

The process according to the present invention essentially eliminates deposition of dust particles on the completed field emitter surfaces, because the field emitters are formed only after the surface of the cathode structure is hermetically sealed from the environment by the gas-tight connection with the anode structure.

According to another feature of the present invention, the electrodes can be raised to the temperature required for depositing the field emitter material on the electrodes by inductive heating. In this way, only the electrodes are heated, whereas all other elements of the FED are kept at a lower temperature which is insufficient for depositing the field emitter material, thereby effectively eliminating the formation of unwanted field emitter layers on FED elements other than the electrodes of the cathode structure.

According to another feature of the present invention, the field emitter material can be deposited on the electrodes by heating the electrodes with an applied current. This approach also prevents the formation of unwanted field emitter layers on the components other than the cathode structure electrodes and has the additional advantage over the first heating method that this heating method does not require additional components (except for a voltage or current source) since the electrodes themselves operate as heaters.

According to another embodiment of the invention, the field emitters can be in the form of carbon-containing layers produced by introducing a carbon-containing carrier gas between the cathode structure and the anode structure. Carbon-containing layers have relatively good field emission properties which makes them suitable for the formation of reliable field emitters. Moreover, deposition conditions for carbon-containing layers are known in the art and, more importantly, such layers can also be produced inside the relatively narrow space between the cathode structure and the anode structure.

According to yet another feature of the present invention, the carbon-containing layers can have the form of nanotube layers. Carbon nanotubes are particularly efficient field emitters, so that an FED produced in this manner can operate reliably for long periods of time at low addressing voltages.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

The invention is directed to a field emission display screen (FED) and, more particularly, to a method for producing such FED under relaxed cleanliness conditions.

Figure 1:
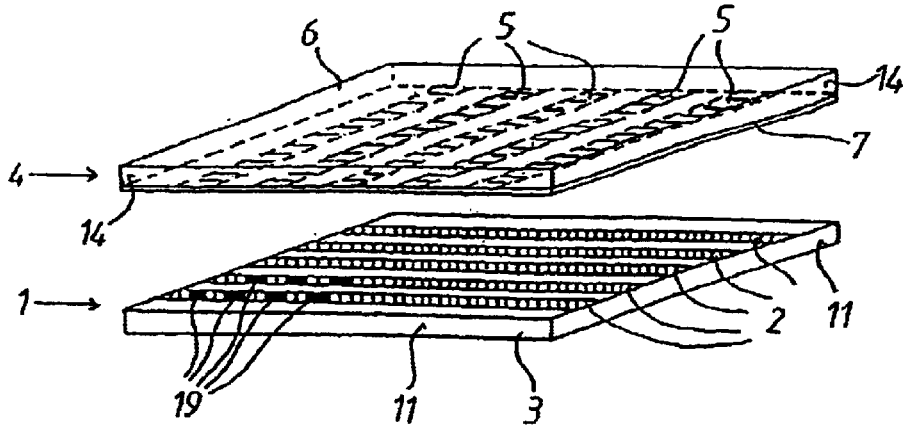
FIG. 1 is a schematic exploded perspective view of a cathode and anode structure of a field emission display screen (FED)

A flat field emission display screen, also referred to as FED, is constructed as schematically shown in FIG. 1. A cathode structure 1 has a plurality of mutually parallel strip-like electrodes 2 disposed on a first substrate 3. A complementary anode structure 4, like the cathode structure 1, also has a plurality of strip-like electrodes 5 disposed on a second substrate 6. The substrate 6 is made of a transparent material, preferably glass, and represents the surface of the FED visible to a user. The electrodes 5 are also formed of a transparent, electrically conducting material, for example, indium tin oxide (ITO), which is known in the art. The electrodes 5 are coated with a layer 7 of luminescent material, for example, a phosphor.

When the FED is completely assembled, the cathode structure 1 and anode structure 2 are aligned in spaced-apart disposition parallel to one another. The electrodes 2 are offset relative to the electrodes 5 by 90°. The pixels 8 of the FED are formed by the overlapping electrode sections of the anode and cathode structure when the anode substrate 6 is viewed from the top (see FIG. 2).

A specific pixel 8 of the FED is activated by applying a voltage with a conventional control electronics, which will not be discussed in detail, to those electrodes 2 and 5 which overlap in the region of the addressed pixel 8. For example, the pixel 8 in the upper left corner is addressed by energizing the first horizontal electrode and the first vertical electrode. The entire area or at least part of the area in the region of a pixel 8 of electrodes 2 of the cathode structure 1 is covered by a material with advantageous field emission characteristics, i.e., a material that emit electrons when an electric field is applied. Materials such as the exemplary "field emitter 19" depicted in the figures are known in the art. The field emitters typically have a free surface that is covered with a plurality of tips. A particularly high electric field strength is produced at these tips which causes emission of electrons.

Examples for such materials are polycrystalline diamond, whiskers and nanotubes. Such materials are known in the art, as is their suitability as field emission electrodes.

The term "whisker" is conventionally used to refer to needle-shaped crystals of high mechanical strength which can include, for example, metals, oxides, borides, carbides, nitrides, polytitanate, carbon and the like. Whiskers are typically single crystalline and in the context of the present invention are preferably electrically conducting. Nanotubes are cylindrical carbon tubes with a hardness approaching that of diamond and can have hemispherical terminations. Their diameter is in the range of 5–30 nm so that they can form the particular fine tips required for this application. They can be deposited in form of a single layer or multiple layers. The fabrication of such nanotubes is described, for example, in "Production of carbon nanotubes", C. Journet, P. Bernier; Applied Physics A, Materials Science & Processing, Springer Verlag 1998, pages 1–9.

When an electric field is produced by applying a voltage between the electrodes 2, 5 in the region of the pixel 8 to be illuminated, electrons are released from the field emitters of the cathode structure 1 and propelled towards the anode structure 4. The electrons strike the phosphor layer 7, exciting the phosphor layer in the region of the pixel to be illuminated. The space between the cathode and the anode structure is evacuated to allow the electrons to travel unhindered from the cathode to the anode.

Cathode structures 1 with field emitters formed by nanotubes have certain advantages over conventional cathode structures produced by the Spindt technology:

The electrons striking the phosphor layer cause the release of ions which spread in the space between the cathode and the anode or are deposited on the cathodes, thereby impairing the operation of the display. This phenomenon is not observed with nanotubes, since the carbon of the nanotubes is chemically inert (like diamond) and therefore does not react with the released ions. Ions originating from the phosphor layer and deposited on the field emitters of the cathode structure can be dislodged from the field emitter by the electron current, since these ions are only physically absorbed on the field emitters, but do not chemically react with the field emitters. FED's constructed from nanotubes therefore tend to have a significantly longer operating life.

Nanotubes can have an adequate field emission efficiency already at a vacuum pressure between the cathode and anode structure of approximately $10^{-5}$–$10^{-6}$ torr instead of the otherwise typical $10^{-8}$ torr.

Like polycrystalline diamond crystals which can also be used as field emitters, nanotubes have an advantageously low emission voltage of approximately 100–200V. Conversely, displays based on Spindt technology require an emission voltage of 1–3 kV.

FED's advantageously consume significantly less energy than conventional flat panel liquid crystal display screens (LCD). Laptop or notebook size LCD's consume typically about 1 to 10W electrical power, whereas FED's can be operated with mW power. Moreover, LCD's have to be viewed straight on, and the image becomes blurred or unrecognizable when viewed from the side at a viewing angle that is only slightly different from 90°. Conversely, FED's have a full viewing angle of 180°, i.e., the displayed image is clearly recognizable even when viewed at an angle. The image displayed on an FED display, unlike an LCD display, can also be viewed even in bright sunlight.

Figure 2:
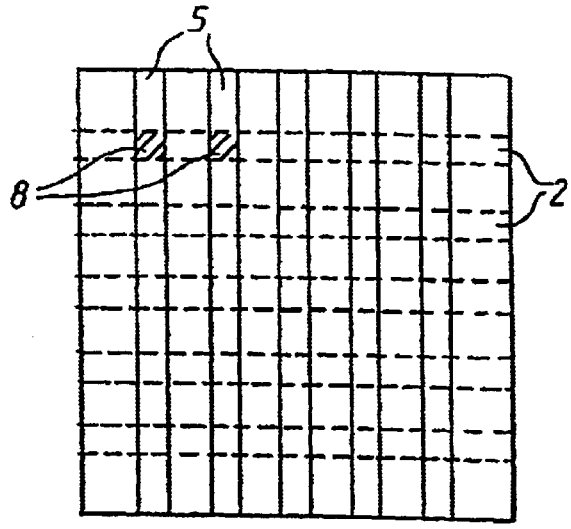
FIG. 2 is a top view of the FED of FIG. 1.

A field emission display of the type depicted in FIGS. 1 and 2 is produced as follows: at first, the electrodes 5 of the anode structure 4 are disposed on a first substrate 6. This can be done by using methods known in the art, such as sputtering or evaporation of a metal, in particular platinum. Subsequently, the layer 7 of a luminescent material is applied to the first substrate 6 so as to cover the electrodes 5. This step can also be implemented using conventional methods. Thereafter, the cathode structure 1 is produced by disposing on a second substrate 3 the metallic electrodes 2—also by conventional methods.

Figure 3:
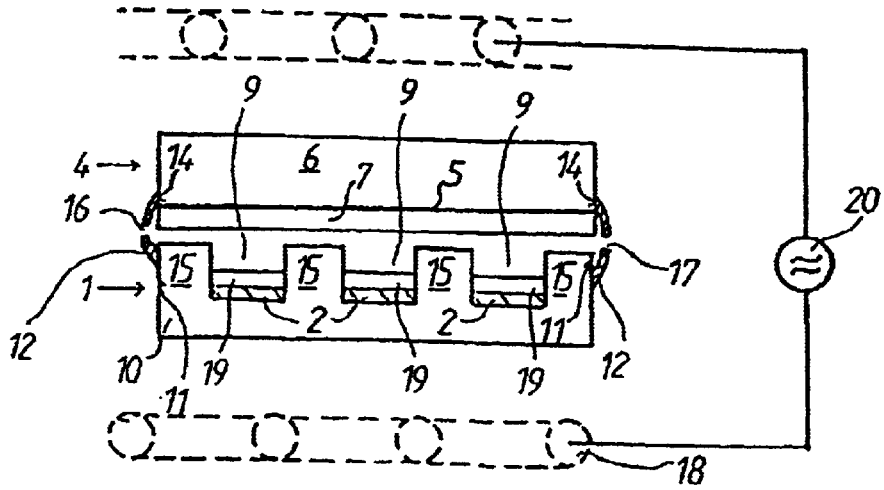
FIG. 3 is a vertical cross-section through an FED, with the cathode structure and anode structure connected to each other in a gas-tight manner.

The electrodes 2 can be applied on a planar substrate surface; however, it is more advantageous to form recesses 9 in the substrate 1, with the electrodes 2 extending into the recesses 9 (see FIG. 3). The electrodes 2 are separated by walls 15 and electrically insulated from each other. In addition, the electrodes 2 have a sufficient spacing from the electrodes 5 of an anode structure which are located on the ridges of the walls 15. Recesses 9 of this type and methods for their preparation are known in the art.

According to the invention, the field emitters 19 are not applied to the electrodes 2 of the cathode structure 1 at this point in the process. Instead, before the field emitters 19 are applied, the cathode and anode structures 1, 4 are aligned parallel with one another in spaced apart disposition and connected along their lateral edges 11, 14 in a gas-tight manner, except for gas inlet and gas outlet openings 16, 17.

The substrates 3, 6 are typically in the form of glass plates. The aforedescribed gas-tight connection can be formed by a glass bead 12 which adheres well to the glass plates and therefore forms a reliable gas-tight connection. As seen in FIG. 3, a gas inlet opening 16 and a gas outlet opening 17 are provided in the glass bead 12. The connection between the cathode and anode substrates 1, 4 is therefore gas-tight except for the gas inlet and outlet openings 16, 17. The separation between the cathode and anode structures 1, 4 can be selected to be identical to the spacing required for the proper operation of the FED. Alternatively, the spacing can be selected at this point to be greater than in the operating state, thereby enlarging the space between the cathode and anode structure 1, 4. This is accompanied by increasing the width of the class bead 12.

Only after the cathode and anode structure 1, 4 are connected in a gas-tight manner are the field emitters 19 formed on the electrodes 2 of the cathode structure 1 by depositing field emitter material onto the electrodes 2 from the gas phase.

Methods for depositing different materials from the gas phase are known in the art. With the method of the invention, however, these materials are deposited only after the cathode and anode structures 1, 4 have been connected in a gas-tight manner. The space between the cathode and anode structures 1, 4 is purged through the gas inlet and the gas outlet openings 16, 17 with a carrier gas that contains a field emitter material.

For depositing field emitter material on the electrodes 2, at least these electrodes 2 must have a sufficiently high temperature, so that at least the electrodes 2 must be heated. Hypothetically, the entire field emission display could be heated; under these circumstances, however, not only the electrodes 2, but also all the other components of the FED would then have a sufficiently high temperature to cause field emitter material to be deposited on these other components, which could adversely affect the operation of the FED. In addition, the luminescent layer 7 is heat-sensitive and could lose its luminescent properties if heated above a certain temperature. Therefore, only the electrodes 2 should be heated to a temperature necessary to deposit the field emitter material.

In a first exemplary embodiment, this can be accomplished through inductive heating: as indicated in FIG. 2 by the dashed lines, the FED is hereby surrounded by a coil 18 that can be connected to an AC voltage source 20.

The coil generates an alternating magnetic field that permeates all components of the FED, with eddy currents only produced in the electrically conducting electrodes 2, which are thereby heated to a temperature necessary to deposit the field emitter material. The inductive heating effect increases with the frequency of the alternating magnetic field, because the magnitude of an induced voltage (and of the heating current produced by this voltage) is directly proportional to the frequency of the alternating magnetic field. The AC voltage source 20 is therefore preferably a high frequency voltage source operating at frequencies above 1 kHz.

According to a second embodiment of the invention, the electrodes 2 are selectively heated by connecting the electrodes 2 to a voltage or current source, with the electrical resistance of the electrodes 2 converting the current to heat.

The process conditions for depositing field emitter material (carrier gas flow in the space between the cathode and anode structure 1, 4 and heating the electrodes 2 to a suitable deposition temperature) are maintained until a sufficiently thick field emitter layer is formed on the electrodes 2. The FED is subsequently purged with the carrier gas, the space between the cathode and anode structure 1, 4 is evacuated, and the gas inlet and gas outlet openings 16, 17 are hermetically sealed.

If the spacing between the cathode and anode structures 1, 4 is still greater than the spacing between these two components that is necessary for a proper operation of the FED, then the glass bead 12 is softened through heating and the two structures 1, 4 are moved towards each other to achieve the correct spacing for proper operation.

As mentioned above, the field emitters 19 must be able to emit electrons under the influence of an electric field. This is an inherent property of, for example, carbon-containing layers, so that the field emitter 19 according to the method of the invention are preferably made of such carbon-containing layers by introducing a carbon-containing carrier gas between the cathode and anode structures 1, 4, from which carrier gas carbon is deposited on the electrodes 2.

As mentioned above, in a particularly preferred embodiment of an FED, the field emitters 19 are provided in the form of carbon nanotubes. These nanotubes are formed by selecting deposition conditions (temperature of the electrodes, carbon content in the carrier gas, flow velocity of the carrier gas) that promote formation of nanotubes when the carbon in the carrier gas is deposited on the electrodes 2. Selection suitable deposition conditions for forming carbon nanotubes is known in the art.

An exemplary process flow for producing field emitters 19 of carbon nanotubes will now be described. Cathode and anode substrate 1, 4 are formed on glass plates made of Pyrex®, which is a boron silicate glass. The electrodes 2 are formed of platinum which is deposited on the cathode substrate 1 by conventional methods. After the cathode and anode substrate are connected through a class bead 12, the remaining space between the two substrates was purged for 15 minutes with nitrogen.

Subsequently, acetylene as a carbon-containing carrier gas was introduced, also in a purge cycle, between the cathode and anode substrate 1, 4. The acetylene flow rate was approximately 15 sccm/min.

The electrodes 2 were then heated to 650° C. by applying a voltage to the electrodes 2, as described above, The magnitude of this voltage was selected according to the geometric dimensions, in particular the length of the electrodes 2, and can be in the range between approximately 5 and 12V. In a second experiment, the electrodes 2 were heated inductively by applying an AC voltage of 2 kV and a current of 0.65 mA to the coil 18 depicted in FIG. 3.

After a temperature of 650° C. was reached, carbon deposits formed on the electrodes 2, causing nanotubes to grow on these electrodes 2 as evidenced by the formation of a homogeneous black layer on the electrodes 2. The aforedescribed process conditions (purging with acetylene and heating the substrate to 650° C.) were maintained for 40 minutes, whereafter the FED was cooled to room temperature by a nitrogen gas flow.

The gas supply and discharge lines were then closed off and the gas inlet opening 16 and the gas outlet opening 17 were sealed in a gas-tight manner. This was accomplished by melting the glass bead 12 in the region of the openings 16, 17 and subsequently allowing these regions to cool down.

While the invention has been illustrated and described as embodied in a method for producing a field emission display, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method for producing a field emission display (FED), comprising the steps of:

providing electrodes of an anode structure on a first substrate;

providing electrodes of a cathode structure on a second substrate; covering the electrodes of the anode structure with a luminescent material;

placing the first substrate against the second substrate, with the electrodes of the anode structure facing the electrodes of the cathode structure;

sealing a space between lateral edges of the first substrate and the second substrate in a gas-tight manner except for a gas inlet and a gas outlet connection;

introducing a carrier gas between the cathode structure and the anode structure and flowing the carrier gas through the gas inlet and gas outlet connections;

heating the electrodes of the cathode structure to a deposition temperature;

depositing field emitters on the electrodes of the cathode structure at the deposition temperature from the carrier gas introduced between the cathode and the anode structure; and sealing the gas inlet and a gas outlet connections.

2. The method of claim 1, wherein the electrodes of the cathode structure are heated to the deposition temperature by inductive heating.

3. The method of claim 1, wherein the electrodes of the cathode structure are heated by flowing a current through the electrodes of the cathode structure.

4. The method of claim 1, wherein the carrier gas comprises carbon and the field emitters are formed of a carbon-containing layer.

5. The method of claim 4, wherein the carbon-containing layers are in the form of nanotube layers.

6. The method of claim 4, wherein the carrier gas comprises acetylene.

* * * * *

UNITED STATES PATENT AND TRADEMARK OFFICE

CERTIFICATE OF CORRECTION

PATENT NO. : 6,722,936 B2
DATED : April 20, 2004
INVENTOR(S) : Ernst Hammel

It is certified that error appears in the above-identified patent and that said Letters Patent is hereby corrected as shown below:

Column 8,
Line 22, after "temperature", replace "from" with -- while maintaining the flow of --

Signed and Sealed this

Thirtieth Day of November, 2004

JON W. DUDAS
*Director of the United States Patent and Trademark Office*